United States Patent [19]

Speidel

[11] 4,040,662

[45] * Aug. 9, 1977

[54] INTEGRAL SEATING UNIT

[76] Inventor: John A. Speidel, 7955 Upper River Road, Maineville, Ohio 45039

[ * ] Notice: The portion of the term of this patent subsequent to July 17, 1990, has been disclaimed.

[21] Appl. No.: 355,656

[22] Filed: Apr. 30, 1973

[51] Int. Cl.[2] ..... A47C 5/12

[52] U.S. Cl. ..... 297/445

[58] Field of Search ..... 297/445, 457, 458, 460

[56] References Cited

U.S. PATENT DOCUMENTS

| | | | |
|---|---|---|---|
| 2,439,690 | 4/1948 | Lippenberger | 297/457 X |
| 2,936,826 | 5/1960 | Reineman | 297/445 X |
| 3,459,449 | 8/1969 | Klausen | 297/445 X |
| 3,512,835 | 5/1970 | Flötotto | 297/457 X |
| 3,561,818 | 2/1971 | Lohmeyer | 297/457 |
| 3,746,394 | 7/1973 | Speidel | 297/445 |

*Primary Examiner*—Peter M. Caun

*Attorney, Agent, or Firm*—Jennings, Carter & Thompson

[57] ABSTRACT

A seating unit comprising supporting structure such as legs or a pedestal and seat only, or supporting structure and seat and back and connecting members, the latter of which may be shaped as arms. The entire structure preferably is formed of a single sheet of bendable or foldable material such as sheet metal. All surfaces of the seating unit are of the types of those ruled surfaces which are developable. Such surfaces are either: (a) plane; or (b) single-curved surfaces, namely cylindrical, conical and convolute; or (c) combinations of (a) and (b). The entire structure is characterized by the absence of any surfaces which are nondevelopable, whereby starting with a flat bendable or foldable sheet of material a seating unit having a seat and supporting structure may be integrally formed without stretching, crumpling, or tearing the sheet. The thus formed structure will receive surface treatment material in sheet form which will lie thereon in mutual conformity therewith likewise without stretching, crumpling or tearing.

6 Claims, 15 Drawing Figures

INTEGRAL SEATING UNIT

My invention relates to seating furniture such as stools, chairs, settees and the like.

In my copending application Ser. No. 173,800, filed Aug. 23, 1971 now U.S. Pat. No. 3,746,394 issued July 17, 1973, I show, describe and claim seating units having seat, back and connecting portions such as arms and formed by bending or folding a flat sheet of material such as sheet metal in such fashion as to maintain at all times developable surfaces wherein the rule lines of the developable surfaces meet upon the surface of the unit at other than straight line running from edge to edge of the countour and wherein the projected images of said rule lines meet upon the developed pattern at other than a straight line running from edge to edge of the pattern. As shown in said application, such seating units require the addition of structural members such as legs or pedestals to support them at proper elevation and position for use. Furthermore, in this art it heretofore has been proposed to make seating units consisting of pedestal, seat and back by folding bendable flat metal sheet material along curved fold lines. However such seating units require edge to edge fastenings or additional structures to prevent the restoration of the material to its original flat condition. By way of example see U.S. Pat. No. 3,295,890, issued to Murdock. The just mentioned construction has inherent disadvantages including the cost of the additional material necessary to attain an edge to edge configuration, the cost of edge to edge fastening, and the cost, including labor, of adding structural members.

My present invention contemplates a seating unit comprising support, seat and back structure which is formed from a plane sheet of material such as sheet metal. I have discovered that configurations suitable for seating structures and the like having support, seat and back sections may be formed by bending and folding such sheet without stretching, crumpling or tearing the sheet thus forming developable ruled surfaces for the component surfaces which are not developable such as ruled warped surfaces and double curved surfaces. The kinds of ruled surfaces which are developable into a flat sheet include surfaces technically defined as: (a) plane surfaces, namely, those surfaces generated by a straight line moving so as to touch two other intersecting or parallel straight lines or a plane curve; or (b) single-curved surfaces, namely, surfaces in which the elements (generatrices) are parallel (cylindrical surfaces), intersect at a common point (conical surfaces), or in which the consecutive elements intersect two and two (convolute surfaces). (See "A Manual of Engineering Drawing For Students and Draftsmen", Thomas E. French, 7th Edition, 1947, page 434; The Encyclopedia Britannica, 1958, Volume 7, page 256, Volume 7, pages 365–367, and Volume 21, page 589). By the exclusive use of these surfaces which are developable, and by not allowing the formation of any undevelopable surfaces, my improved seating structure may be economically and simply formed, is extremely strong even though formed of relatively thin material and affords a large number of pleasing, utilitarian seating units. Since the entire structure including the supporting section is developable, surface treatment such as cloth, sheet "plastic" material and the like may be applied thereto, likewise without the necessity of stretching, crumpling or goring. Further, by following the teachings of my invention seating structures may be formed of sheet material which later may be rigidized.

My invention has for an object, also, the provision of seating units of the character designated which may be formed with or without arms and which may have convex, concave or flat seats and back portions, or combinations of these configurations while maintaining in all of them the aforementioned characteristics of developable surfaces throughout.

Generally stated, I carry out my invention by first peripherally shaping the sheet of material to provide the seating unit support and seat, or, the support, seat and back, or, the support, seat, back and arm shapes all of the relative dimensions desired. The sheet is now bent or folded along predetermined lines so selected as to form one, some, or a combination of the types of developable ruled surfaces mentioned above. In every case it will be found that there are produced either plane surfaces, conical surfaces, cylindrical surfaces, or convolute surfaces, wherein the generatrices of each type surface meet within the confines of the sheet at: (a) a point or points; (b) a straight line or lines, one end at least of each of which lines terminates short of the edge of the sheet, namely within the sheet; (c) a curved line or lines; or (d) various combinations of points as in (a), above, straight lines as in (b), above, or curved lines as in (c), above.

In summary, therefore, relative to the objects of my invention I propose a seating unit comprising a support, seat and back, and if desired, arm structure, in which every part of the same is made up of various ones of the fully developable ruled surfaces technically and generically termed developable ruled surfaces, whereby the same may be bent without in any way stretching, crumpling, or tearing the sheet.

Seating units and blanks for forming the same embodying the features of my invention are shown in the accompanying drawings forming a part hereof in which.

Figure 3:
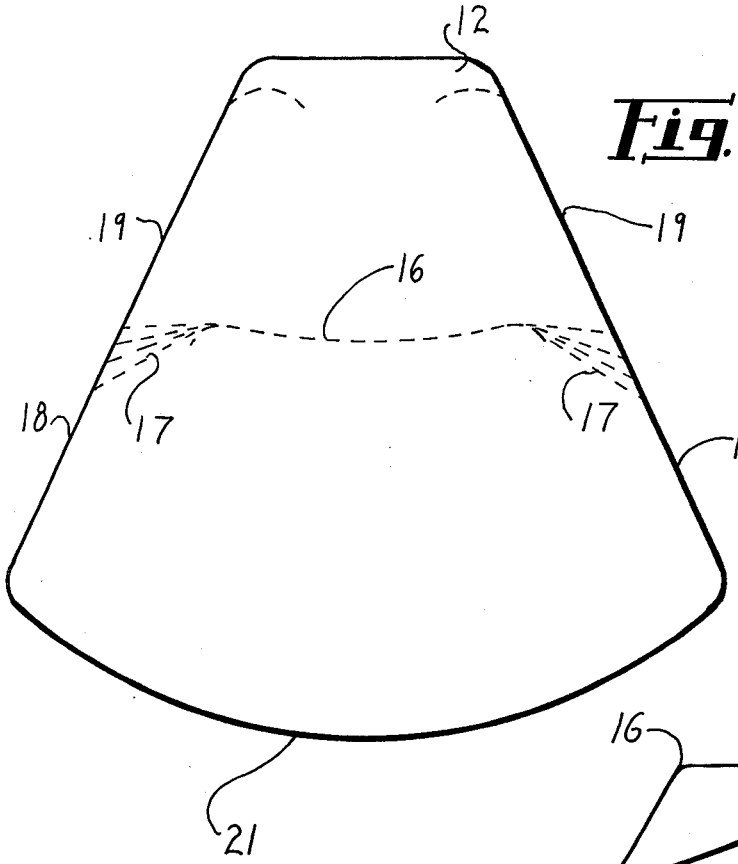
FIG. 3 is a plan view of a developed blank from which the stool of FIGS. 1 and 2 may be formed.
Figure 1:
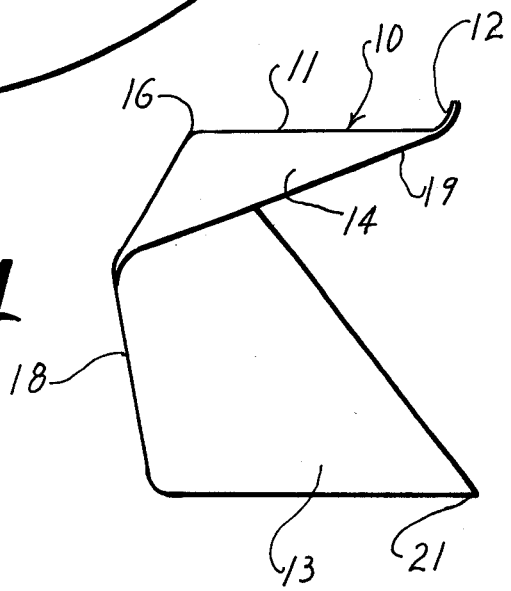
FIG. 1 is a side elevational view of a stool incorporating the features of my invention.
Figure 2:
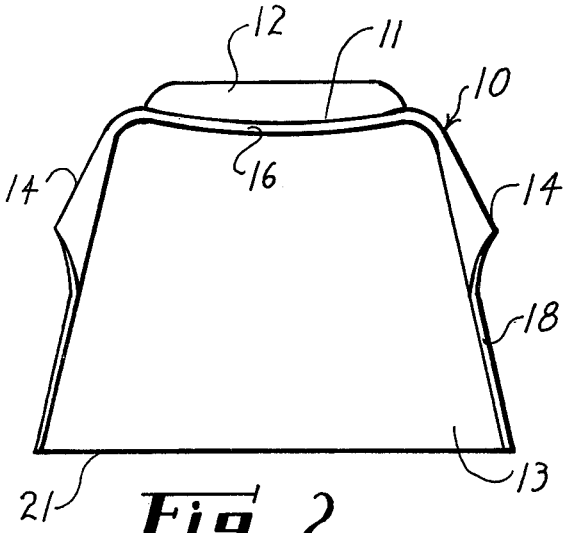
FIG. 2 is a front elevational view of the stool shown in FIG. 1.
Figure 6:
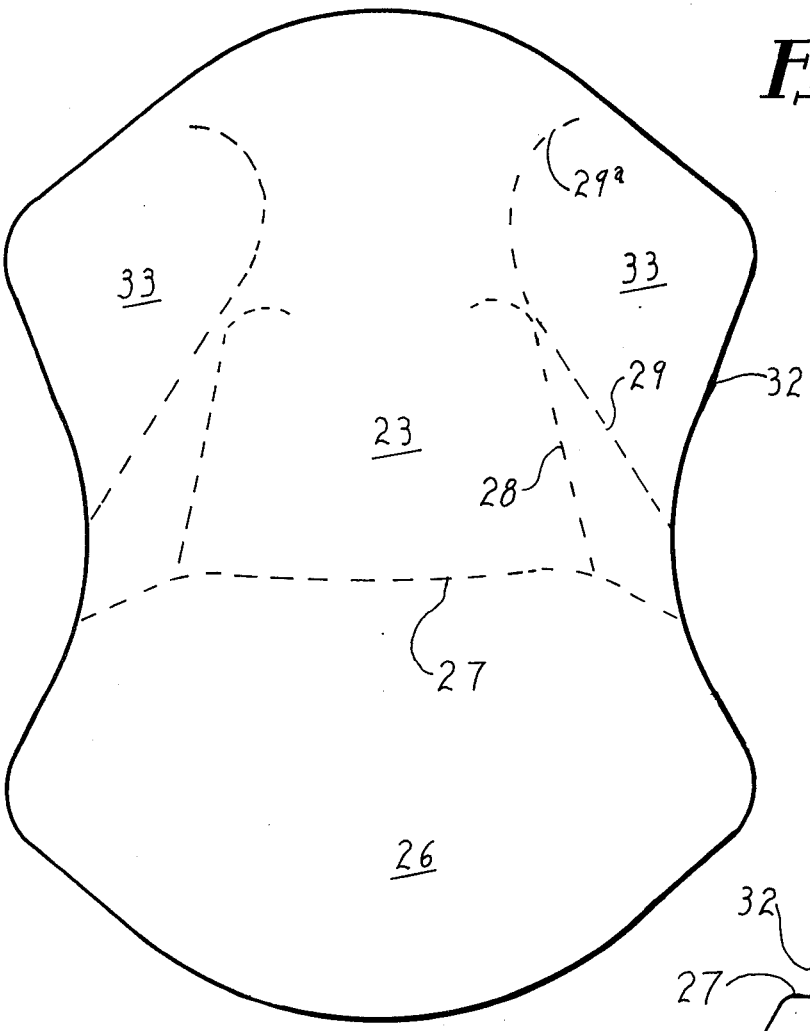
Figure 4:
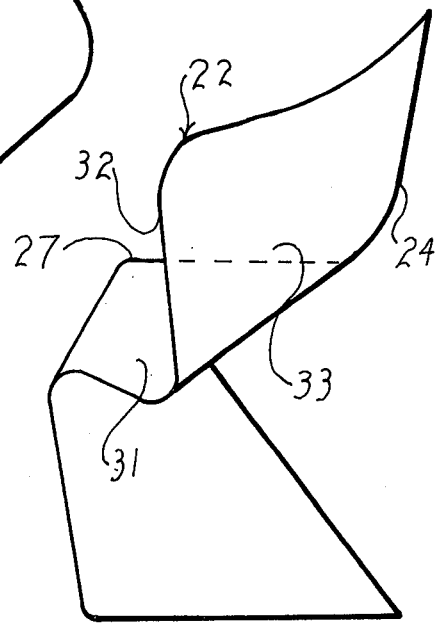
Figure 5:
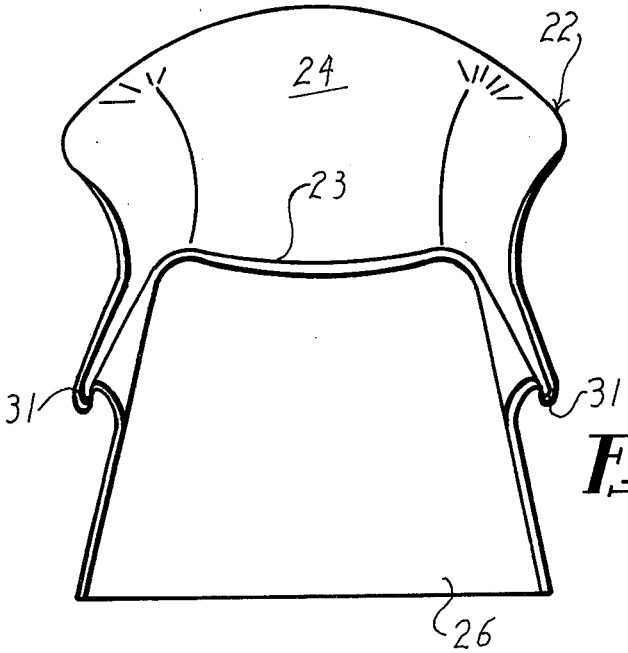
Figure 9:
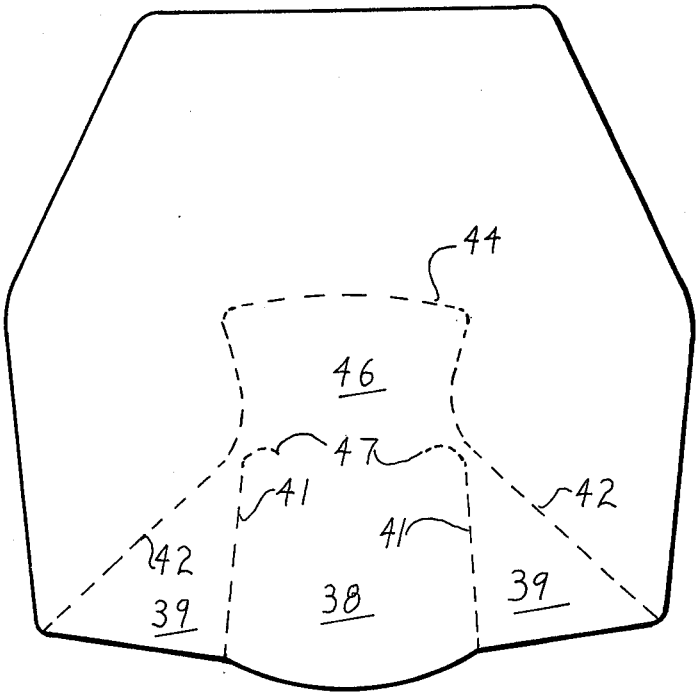
Figure 7:
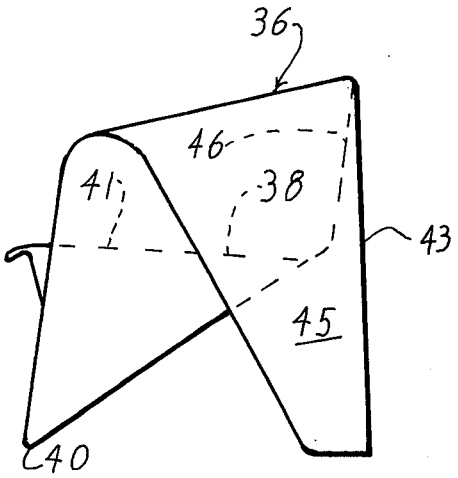
Figure 8:
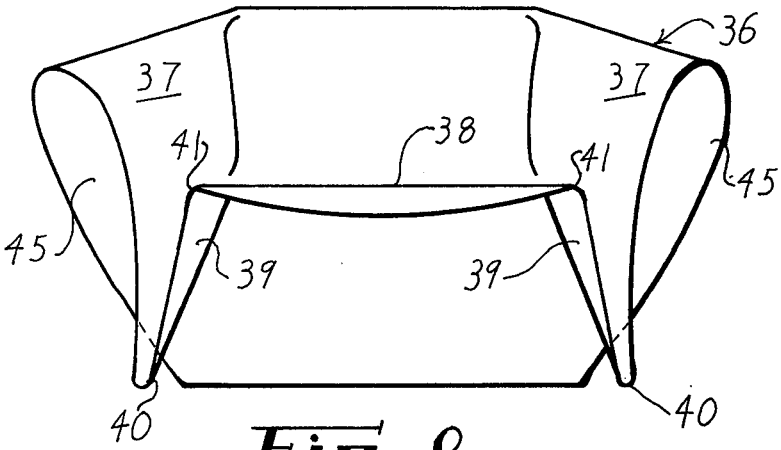
Figure 12:
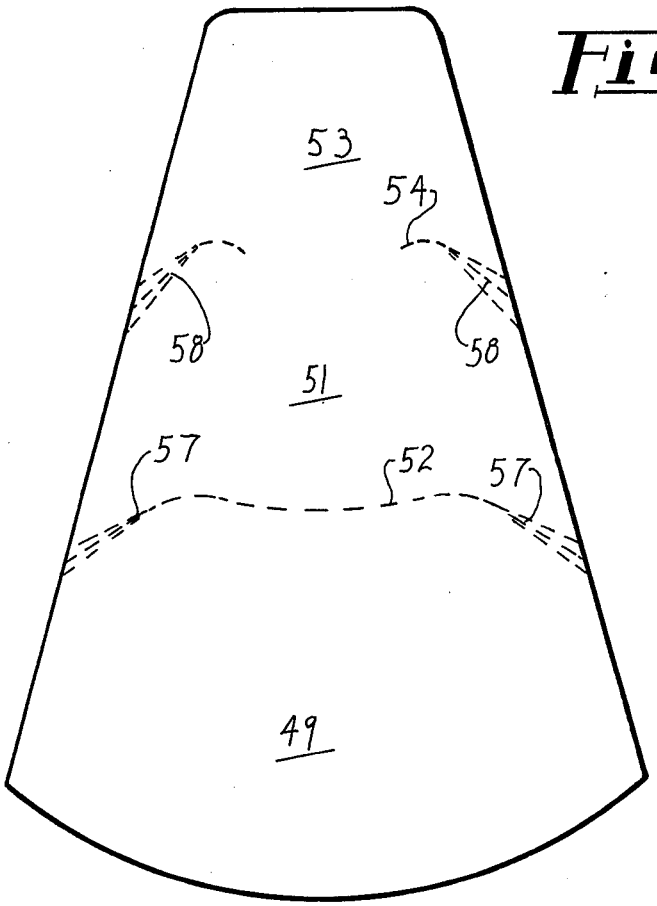
Figure 10:
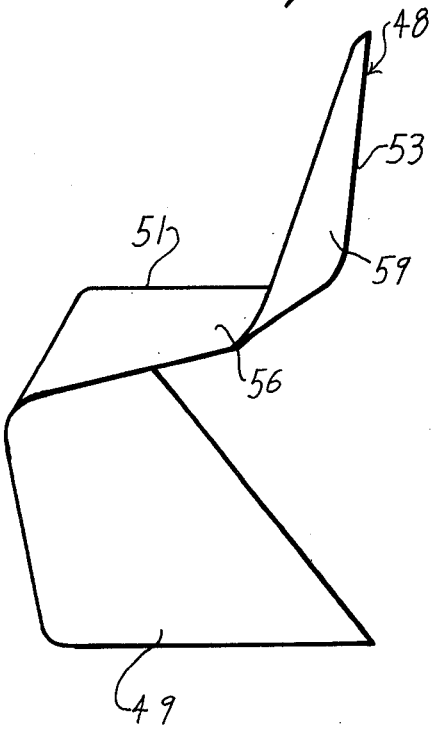
Figure 11:
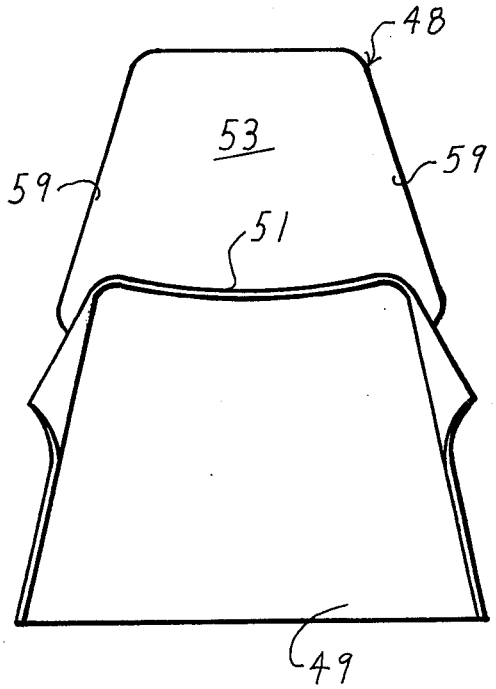
Figure 14:
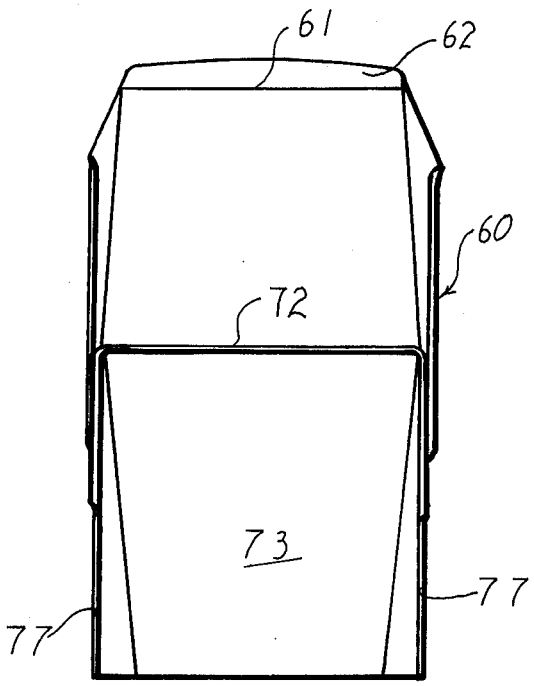
Figure 13:
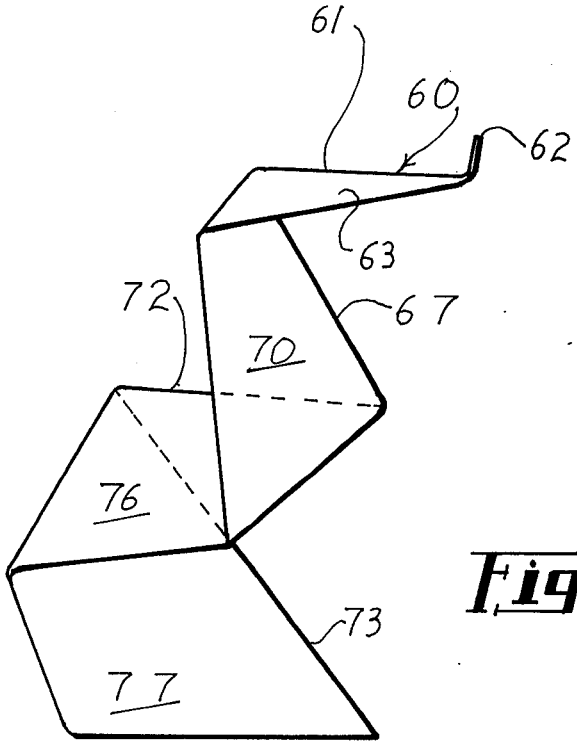
Figure 15:
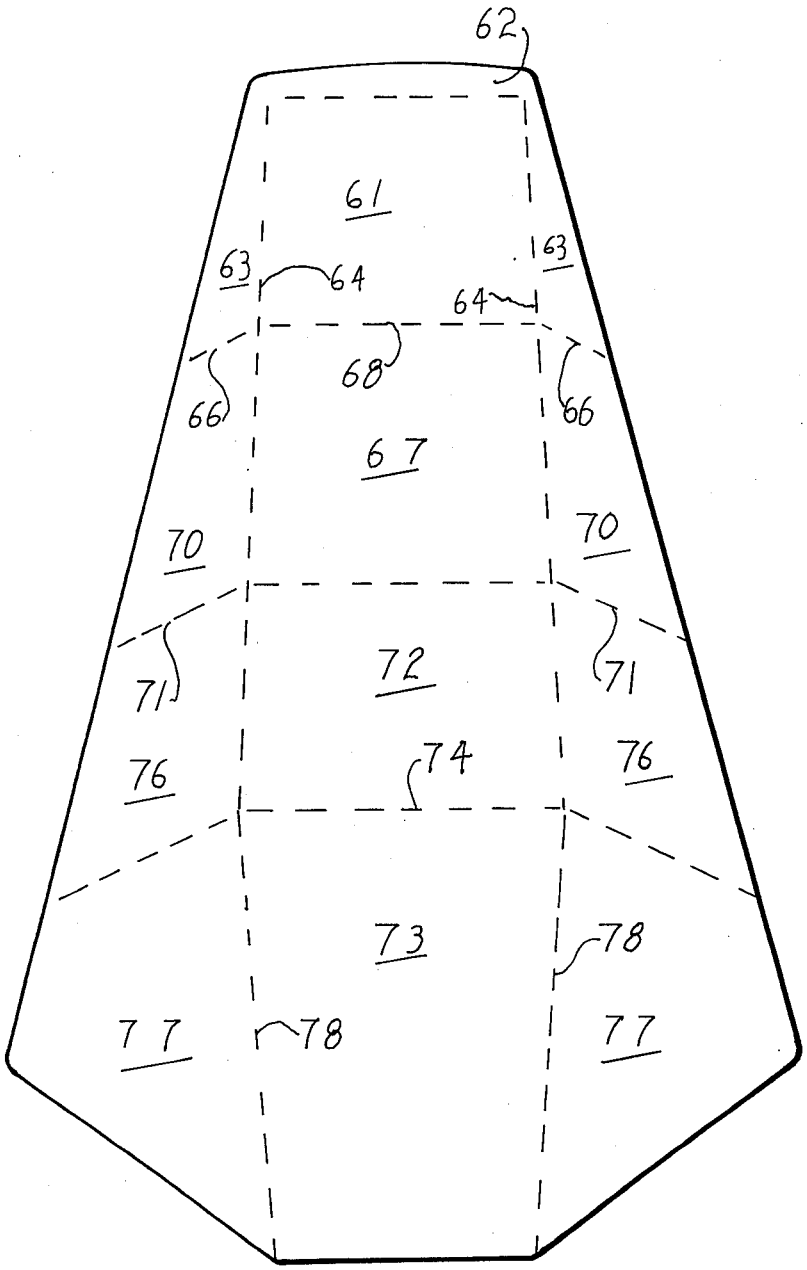

FIGS. 4 to 6, inclusive, are figures corresponding to FIGS. 1 to 3, inclusive, and showing a chair and a blank therefor which may be formed in accordance with my invention;

FIGS. 7 to 9, inclusive, are views corresponding to FIGS. 1 to 3, inclusive, and showing another form of chair;

FIGS. 10 to 12, inclusive, are views corresponding to FIGS. 1 to 3, inclusive, and showing still another form of chair; and, FIGS. 13 to 15, inclusive, are views corresponding to FIGS. 1 to 3, inclusive, and showing a combined stool and step ladder which may be made in accordance with my invention.

Referring now to the drawings for a better understanding of my invention and particularly FIGS. 1, 2 and 3 I show a stool indicated generally by the numeral 10 which is formed from a single, unitary sheet of material such as sheet metal. The stool is provided with a seat portion 11 and there may be a slightly upturned back section 12. Formed integrally with the seat is a floor engaging supporting portion 13 and the seat proper and the portion 13 are connected by the sections 14 disposed along the sides of the stool.

It will be seen that by bending along the curved line indicated at 16 and the lines indicated at 17 the stool shown in these figures is formed. Referring to the blank shown in FIG. 3 the vertical side edges of the formed stool indicated by the number 18 are similarly indicated on the blank; the bottom edges of the portions 14 are indicated by the numeral 19.

It will be seen that by rounding the blank as indicated by the line 21 the bottom, rounded, floor engaging section is formed. Sections 14 add considerable strength since they are what might be called gussets extending between the portions 11 and 13. It is to be particularly noted that if folded or bent in accordance with the showing of these figures the material of the sheet is in no way stretched, crumpled, or torn since all sections are ruled surfaces of the kind which are fully developable. It will also be noted that any of the straight lines such as the lines 17 about which the material is folded have at least one of their ends lying in the confines of the sheet of material. Thus, by simple folding and without stretching, crumpling, tearing or upsetting the material I provide the stool of FIGS. 1 to 3. In practice this stool has proven to be extremely stable and extremely strong, even when made of relatively light weight sheet steel.

In FIGS. 4 to 6, inclusive, I show a chair which has an integrally formed supporting portion. Thus, the chair indicated by the numeral 22 is what might be generally described as a wing back chair. The chair embodies the seat portion proper indicated by the numeral 23, a back 24 and a base or supporting portion 26.

The blank for forming the chair 22 is illustrated in FIG. 6 and by bending along the dotted line 27 one may provide the seat section 23 of the blank, integrally connected to the supporting section 27. By folding or bending the metal downwardly between the dotted lines 28 and 29 as shown on the pattern there may be provided downwardly depending, curved strengthening sections 31 having side edges which merge into the back section 24, along the side lines 32. The wing sections at the sides of the chair indicated at 33 are provided by forwardly folding the material along the line 29, including the curved portion thereof **29*a*. See FIG. 6. It will further be seen that downwardly from the line 27 the entire base portion may be concave as viewed from the front of the chair, FIG. 5,** thus to provide considerable strength both for the seat and back of the chair.

As with the modifications first described the chair of FIGS. 5 to 6, inclusive, may be formed by simple bending and folding of the metal of the sheet, without any stretching, crumpling or tearing of the sheet. The item of seating furniture being described thus comprises an integrally formed seat, back and base or supporting section, all formed as stated by simple bending. No dies, elaborate molds, forms or the like are required, and this chair, as well as all the others herein disclosed, may readily be formed through use of the most simple bending and forming tools.

Referring now to FIGS. 7 to 9, inclusive, I show another form of chair indicated generally by the numeral 36. This chair may be described as a modern style arm chair, the arms of which are indicated at 37.

In forming the chair FIGS. 7 to 9 the blamnk is contoured as illustrated in FIG. 9 and is bent along the dotted lines indicated. Thus, the seat portion 38 is joined by downwardly and outwardly extending panel sections 39, the latter being defined between the lines 41 and 42 of the blank. The panels 39 are joined to the lower sections of the panels of the blank which form the arms 37, thus resulting in the provision of what might generally be termed a pair of supporting "legs" adjacent the front of the chair. The bottoms of these legs are indicated by the numeral 40.

The blank is also bent to form, from the tops of the arms 37 and thence downwardly, panel sections 45. These sections 45 join the back 43 of the chair along the line 44 indicated in FIG. 9. In other words, the back of the chair proper is the panel 46 between the line 44 and the inturned corner fold lines 47, FIG. 9.

Like the modifications so far described all the surfaces of the chair of FIGS. 7 to 9, inclusive, are plane or single curved, there being no undevelopable surfaces in any part of such chair. Again, there is no stretching, crumpling or tearing of the sheet and starting with the blank as shaped in FIG. 9 I am able to produce the seating unit. By the expression "without stretching, crumpling, or tearing" I do not imply the elimination of that which occurs transversely across a bend in material of necessity having thickness, known to those versed in the art as "crowding" of the material. (see French, page 435, line 23).

Referring now to FIGS. 10 to 12, inclusive, I shown still another form of chair indicated generally by the numeral 48. In this instance the supporting section 49 is concave as viewed from the front and is formed from the panel correspondingly numbered shown in FIG. 12. The seat proper indicated by the numeral 51 and by the panel of the same number in FIG. 12 is formed by bending the panel 49 downwardly along the line 52, FIG. 12 and by bending the back panel 53 upwardly relative to the fold or bend lines 54, FIG. 12. Also, and as illustrated, I provide the side disposed panels 56 by bending the same downwardly in the side areas between the lines 57 and 58, FIG. 12. It will also be seen that the seat can be slightly concave as viewed from the top of the seating surface and that the back may have wing portions or panels 59 by simply bending a portion of the sides of the back panel forwardly as shown.

Again, by simple folding, bending and without stretching, tearing or crumpling the sheet the seating unit of these figures is produced. It will be noted further that with respect to all of the modifications of my invention only the very simplest of bending and folding mechanisms are required to bring about the results desired. In other words, I eliminate, as already stated, the requirement for expensive dies, expensive jigs and the like, it being necessary only to provide bending bars, shapes and the like which engage the sheet while holding it generally against following the movable bending or forming tools, whereupon the sheets take the shapes shown and described.

Referring now to FIGS. 13 and 15, inclusive, I show a combined seating stool and two step ladder which may be made following the teaching of my invention. This combined step ladder and stool is indicated generally by the numeral 60 and as illustrated comprises the uppermost, generally horizontal portion 61 which is the seat of the stool itself. The portion 61 may have an upturned, rearwardly formed lip portion 62, this same portion being illustrated on the blank, FIG. 15. Downwardly extending side portions may be provided adjacent the seat 61 as shown at 63 by bending the same downwardly between the dotted lines 64 and 66 as shown on the pattern.

A downwardly and somewhat rearwardly inclined panel 67 is joined to the panel 61 along the line 68. Side panels, forwardly extending and downwardly extending relative to the panel 67 are indicated by numeral 70, these being formed between the lines 71 and 66 as shown.

Joined to the bottom edge of the panel 67 is another generally horizontally disposed panel 72, this forming a "step" which in combination with the "seat" portion 61 provides the step ladder. The panel 72 is joined to the lowermost panel 73 along the bend line 74, FIG. 15. Additional strengthening side panels 76 may be provided for the superstructure. The panel 73 of the base may be connected by forwardly extending side panels 77, connected to the panel 73 along its side edges as indicated at 78.

As best shown in FIG. 14 the various side panels 63, 68, 76 and 77 may be folded substantially flat against the adjacent ones of the same, thus decreasing the overall width of the stool-step ladder.

In view of the foregoing it will be seen that I have devised an improved seating unit. With any of the modifications disclosed, and with many more, which, in view of the invention will be apparent to those skilled in the art, one may start with a unitary sheet of material such as sheet metal and by the proper folding as disclosed herein produce seating units of various shapes, sizes, configurations and designs. The sheet material may be of uniform thickness; however, thinner materials may be employed when the periphery of the shaped sheet has been turned back upon itself or over an edging wire, thus providing the sheet with a stiffened edge, which sheet may then be folded to form a seating unit. With all my seating units, if manufactured in accordance with my invention, there is no stretching, tearing or crumpling of the sheet itself. Furthermore, it is possible to start with a sheet of material, from the seating unit, temporarily support it and then rigidize the sheet, thus to provide what might appear, after manufacture, to be a molded seating unit.

As will be understood, my invention is characterized by the fact that nowhere in any of the various surfaces are there any shapes, contours or layouts which are not fully developable, namely, which are not in fact either flat surfaces, conical surfaces, cylindrical surfaces, or convolute surfaces. My improved seating unit is thus characterized by the presence of all developable surfaces and the complete absence of all surfaces which are undevelopable. Just as one may start with any of the seating units disclosed, in completed form, and again flatten the sheets, the reverse is true so long as the surfaces in truth are developable.

In all cases rule lines of the surfaces comprising the seating unit contour, and when the images of such rule lines are projected upon the pattern from which the seating unit is formed, these images also meet on the pattern. Further, in the contour and on the pattern the lines and their projected images meet at other than a straight line which extends from edge to edge of the contour and pattern, respectively. Amplifying the statements just made and referring by way of example to FIGS. 7 to 9, inclusive, it will be seen that the straight lines 41 while extending from one edge of the contour and pattern, have ends which terminate within the confines of the contour of the seating unit and the perimeter of the pattern and this is true of all straight lines extending from an edge of contour and pattern in all modifications shown. Lines 41 in FIG. 9 are the projected images of lines 41 in FIG. 8. While the chairs described and claimed in my U.S. Pat. No. 3,746,394, column 2, lines 10–20 and column 6, lines 51–58, are all developable from plane and single curved surfaces wherein the rule lines and their images when projected on the pattern meet upon the contour and pattern, respectively, at a point on the contour and pattern, respectively, at a straight line one end of which terminates short of the edge of the contour and pattern, respectively, or a curved line upon the contours and pattern, respectively, none of them become completed seating units without the addition of structural members. In the seating furniture herein disclosed, all are provided with integrally formed bases or supporting structures.

In actual practice my invention has proven to be extremely satisfactory and I am able to provide an enormous number of pleasing and very strong seating structures. The connecting portions such as the arms of course add strength and as shown may be provided both for appearance and utility.

While I have shown my invention in several forms, it will be obvious to those skilled in the art that it is not so limited, but is susceptible of various other changes and modifications without departing from the spirit thereof.

What I claim is:

1. A seating unit integrally formed from a single sheet of material comprising, a. a seat section and support section joined by connecting sections, b. the entire support seat and connecting sections being developable to a unitary flat pattern, c. said support, seat, and connecting sections being ruled surfaces in which rule lines thereof meet upon the contour of the unit, the images of said rule lines when projected on the pattern meeting on the pattern, d. rule lines of the contours and the images thereof when projected on the pattern meeting at other than a straight line extending from edge to edge of the contour and pattern, respectively, and e. the seating unit thus formed being self-sustaining and load-carrying.

2. The seating unit of claim 1 having a back section joined to the seat section.

3. A unit as defined in claim 1 in which rule lines of the surfaces comprising said contour and the images thereof projected on the pattern meet upon the surfaces of the contour and pattern at a point upon the contour and pattern, respectively, within the confines of the contour and pattern.

4. A seating unit as defined in claim 1 in which rule lines of the surfaces comprising said contour and the images thereof projected on the pattern meet upon the surfaces of the contour and pattern, respectively, at a straight line, or lines, one end at least of which terminates within the contour and pattern short of the edges thereof.

5. A seating unit as defined in claim 1 in which rule lines of the surfaces comprising said contour and the images thereof projected on the pattern meet upon the surfaces of the contour and pattern, respectively, at a curved line upon the contour and pattern, respectively.

6. In an integral seating unit, a. support and seat structure formed from a unitary sheet of bendable material, b. said sheet being bent along a combination of curved and straight lines, the latter of which have at least one of their ends terminating within the confines of the sheet, c. all portions of said structure being made up of ruled surfaces which are developable, whereby the entire structure may be formed from said sheet without stretching, tearing or crumpling the sheet, and d. the support and seat structure thus formed being self sustaining and load carrying.

* * * * *